US006576186B1

(12) United States Patent
Martin et al.

(10) Patent No.: US 6,576,186 B1
(45) Date of Patent: Jun. 10, 2003

(54) ENHANCED MACHINABILITY PRECIPITATION-HARDENABLE STAINLESS STEEL FOR CRITICAL APPLICATIONS

(75) Inventors: James W. Martin, Sinking Spring, PA (US); Roland E. Schmitt, Mohnton, PA (US); Ronald C. Gower, Reading, PA (US)

(73) Assignee: CRS Holdings, Inc., Wilmington, DE (US)

( * ) Notice: Subject to any disclaimer, the term of this patent is extended or adjusted under 35 U.S.C. 154(b) by 0 days.

(21) Appl. No.: 09/936,379

(22) PCT Filed: Mar. 8, 2000

(86) PCT No.: PCT/US00/05916

§ 371 (c)(1),
(2), (4) Date: Nov. 29, 2001

(87) PCT Pub. No.: WO00/53821

PCT Pub. Date: Sep. 14, 2000

Related U.S. Application Data

(60) Provisional application No. 60/123,230, filed on Mar. 8, 1999.

(51) Int. Cl.[7] ..... C22C 38/42; C22C 38/48
(52) U.S. Cl. ..... 420/60; 420/61; 148/325
(58) Field of Search ..... 148/325; 420/60, 420/61

(56) References Cited

U.S. PATENT DOCUMENTS 2,850,380 A 9/1958 Clarke
4,769,213 A 9/1988 Haswell, Jr. et al.

OTHER PUBLICATIONS

Aerospace Material Specification No. AMS 5659H, "Steel, Corrosion Resistant Bars, Wire Forgings, Rings, and Extrusions", SAE (1995).

*Primary Examiner*—Deborah Yee
(74) *Attorney, Agent, or Firm*—Dann, Dorfman, Herrell and Skillman, P.C.

(57) ABSTRACT

A precipitation-hardenable, martensitic stainless steel alloy is described having the following composition in weight percent.

| | |
|---|---|
| C | 0.030 max. |
| Mn | 1.00 max. |
| Si | 1.00 max. |
| P | 0.030 max. |
| S | 0.005–0.015 |
| Cr | 14.00–15.50 |
| Ni | 3.50–5.50 |
| Mo | 1.00 max. |
| Cu | 2.50–4.50 |
| Nb + Ta | (5 × C)–0.30 |
| Al | 0.05 max. |
| B | 0.010 max. |
| N | 0.030 max. |

and the balance is essentially iron and the usual impurities. The alloy provides a unique combination of properties in that useful articles made therefrom provide superior machining characteristics relative to known high strength 15Cr-5Ni precipitation-hardenable stainless steel alloys, while meeting the strength, ductility, and hardness requirements specified in AMS 5659 for critical applications.

19 Claims, No Drawings

ENHANCED MACHINABILITY PRECIPITATION-HARDENABLE STAINLESS STEEL FOR CRITICAL APPLICATIONS

This application claims the benefit of priority of U.S. Provisional Application No. 60/123,230, filed Mar. 8, 1999.

FIELD OF THE INVENTION

This invention relates to high strength stainless steel alloys and, in particular, to a precipitation-hardenable, martensitic stainless steel alloy having a unique combination of strength, ductility, toughness, and machinability.

BACKGROUND OF THE INVENTION

Aerospace material specification AMS 5659 describes a 15Cr-5Ni precipitation hardenable, corrosion resistant steel alloy for use in critical aerospace components. AMS 5659 specifies minimum strength and ductility requirements which the alloy must meet after various age-hardening heat treatments. For example, in the H900 condition (heated at about 900 F. (482 C.) for 1 hour and then air cooled), a conforming alloy must provide a tensile strength of at least 190 ksi (1310 MPa) in both the longitudinal and transverse directions together with an elongation of at least 10% in the longitudinal direction and at least 6% in the transverse direction. However, products manufactured to meet that specification typically lack the ease of machinability desired by component fabricators.

As the alloy specified in AMS 5659 continues to be used in many structural components for aerospace applications, a need has arisen for an alloy that meets all of the mechanical requirements of AMS 5659, but which also provides superior machinability. It is generally known to add certain elements such as sulfur, selenium, tellurium, etc. to stainless steel alloys in order to improve their machinability. However, the inclusion of such "free-machining additives", without more, will adversely affect the mechanical properties of the alloy, such as toughness and ductility, to the point where the alloy becomes unsuitable for the critical structural components for which it was designed. Consequently, a need exists for a precipitation-hardenable martensitic stainless steel having good ductility, toughness, and notch tensile strength to be useful for critical applications and which also provides superior machinability compared with alloy compositions currently utilized for fracture-critical components.

SUMMARY OF THE INVENTION

The present invention is directed to a precipitation-hardenable martensitic stainless steel which provides mechanical properties (tensile and notch strength, ductility, and toughness) that meet the requirements of AMS 5659 and which also provides significantly better machinability compared to the known grades of 15Cr-5Ni precipitation-hardenable stainless steels. The broad, intermediate, and preferred weight percent compositions of the alloy according to this invention are set forth in the following table.

| | Weight percent | | |
|---|---|---|---|
| Element | Broad | Intermediate | Preferred |
| C | 0.030 max. | 0.025 max. | 0.010–0.025 |
| Mn | 1.00 max. | 0.50 max. | 0.50 max. |

-continued

| | Weight percent | | |
|---|---|---|---|
| Element | Broad | Intermediate | Preferred |
| Si | 1.00 max. | 0.60 max. | 0.50 max. |
| P | 0.030 max. | 0.030 max. | 0.025 max. |
| S | 0.005–0.015 | 0.005–0.015 | 0.007–0.013 |
| Cr | 14.00–15.50 | 14.00–15.50 | 14.25–15.25 |
| Ni | 3.50–5.50 | 3.50–5.50 | 4.00–5.50 |
| Mo | 1.00 max. | 0.50 max. | 0.50 max. |
| Cu | 2.50–4.50 | 2.50–4.50 | 3.00–4.00 |
| Nb + Ta | (5 × C) − 0.30 | (5 × C) − 0..25 | (5 × C) − 0.20 |
| Al | 0.05 max. | 0.025 max. | 0.025 max. |
| B | 0.010 max. | 0.005 max. | 0.005 max. |
| N | 0.030 max. | 0.025 max. | 0.010–0.025 |
| Fe | Bal. | Bal. | Bal. |

The foregoing tabulation is provided as a convenient summary and is not intended thereby to restrict the lower and upper values of the ranges of the individual elements for use in combination with each other, or to restrict the ranges of the elements for use solely in combination with each other. Thus, one or more of the ranges can be used with one or more of the other ranges for the remaining elements. In addition, a minimum or maximum for an element of a broad, intermediate, or preferred composition can be used with the minimum or maximum for the same element in another preferred or intermediate composition. Here and throughout this specification the term "percent" or the symbol "%" means percent by weight unless otherwise specified.

DETAILED DESCRIPTION OF THE INVENTION

The interstitial elements carbon and nitrogen are restricted to low levels in this alloy in order to benefit the machinability of the alloy. Therefore, the alloy contains not more than about 0.030% each of carbon and nitrogen and preferably not more than about 0.025% of each of those elements. Carbon and nitrogen are strong austenite stabilizing elements and limiting them to levels that are too low leads to the formation of undesirable amounts of ferrite in this alloy. Therefore, at least about 0.010% each of carbon and nitrogen is preferably present in the alloy.

This alloy contains a controlled amount of sulfur to benefit the machinability of the alloy without adversely affecting the ductility, toughness, and notch tensile strength of the alloy. To that end, the alloy contains at least about 0.005% and preferably at least about 0.007% sulfur. Too much sulfur adversely affects the ductility, toughness, and notch tensile strength of this alloy. Therefore, sulfur is restricted to not more than about 0.015% and preferably to not more than about 0.013% in this alloy.

At least about 14.00% and preferably at least about 14.25% chromium is present in the alloy to provide an adequate level of corrosion resistance. However, when chromium is present in excess of about 15.50% the formation of undesirable ferrite results. Therefore, chromium is restricted to not more than about 15.50% and preferably to not more than about 15.25% in this alloy.

At least about 3.50%, preferably at least about 4.00%, nickel is present in the alloy to maintain good toughness and ductility. Nickel also benefits the austenite phase stability of this alloy at the low levels of carbon and nitrogen used in the alloy. The strength capability of the alloy in the aged condition is adversely affected when more than about 5.50% nickel is present because of incomplete austenite-tomartensite transformation (i.e., retained austenite) at room temperature. Therefore, this alloy contains not more than about 5.50% nickel.

At least about 2.50%, preferably at least about 3.00%, copper is present in this alloy as the primary precipitation hardening agent. During the age hardening heat treatment, the alloy achieves substantial strengthening through the precipitation of fine, copper-rich particles from the martensitic matrix. Copper is present in this alloy in amounts ranging from 2.50 to 4.50% to provide the desired precipitation hardening response. Too much copper adversely affects the austenite phase stability of this alloy and can lead to formation of excessive austenite in the alloy after the age hardening heat treatment. Therefore, copper is restricted to not more than about 4.50% and preferably to not more than about 4.00% in this alloy.

A small amount of molybdenum is effective to benefit the corrosion resistance and toughness of this alloy. The minimum effective amount can be readily determined by those skilled in the art. Too much molybdenum increases the potential for ferrite formation in this alloy and can adversely affect the alloy's phase stability by promoting retained austenite. Therefore, while this alloy may contain up to about 1.00% molybdenum, it preferably contains not more than about 0.50% molybdenum.

A small amount of niobium is present in this alloy primarily as a stabilizing agent against the formation of chromium carbonitrides which are deleterious to corrosion resistance. To that end the alloy contains niobium in an amount equivalent to at least about five times the amount of carbon in the alloy (5×%C). Too much niobium, particularly at the low carbon and nitrogen levels present in this alloy, causes excessive formation of niobium carbides, niobium nitrides, and/or niobium carbonitrides and adversely affects the good machinability provided by this alloy. Too many niobium carbonitrides also adversely affect the alloy's toughness. Furthermore, excessive niobium results in the formation of an undesirable amount of ferrite in this alloy. Therefore, niobium is restricted to not more than about 0.30%, better yet to not more than about 0.25%, and preferably to not more than about 0.20%. Those skilled in the art will recognize that tantalum may be substituted for some of the niobium on a weight percent basis. However, tantalum is preferably restricted to not more than about 0.05% in this alloy.

A small but effective amount of boron may be present in amounts up to about 0.010%, preferably up to about 0.005%, to benefit the hot workability of this alloy.

The balance of the alloy composition is iron except for the usual impurities found in commercial grades of precipitation hardening stainless steels intended for similar use or service. For example, aluminum is restricted to not more than about 0.05% and preferably to not more than about 0.025% in this alloy because aluminum can form aluminum nitrides and aluminum oxides which are detrimental to the good machinability provided by the alloy. Other elements such as manganese, silicon, and phosphorus are also maintained at low levels because they adversely affect the good toughness provided by this alloy. The composition of this alloy is balanced so that the microstructure of the steel undergoes substantially complete transformation from austenite to martensite during cooling from the annealing temperature to room temperature. As described above, the constituent elements are balanced within their respective weight percent ranges such that the alloy contains not more than about 2 volume percent (vol. %) ferrite, preferably not more than about 1 vol % ferrite, in the annealed condition.

The alloy according to this invention is preferably melted by vacuum induction melting (VIM), but can also be arc-melted in air (ARC). The alloy is refined by vacuum arc remelting (VAR) or electroslag remelting (ESR). The alloy may be produced in various product forms including billet, bar, rod, and wire. The alloy may also be used to fabricate a variety of machined, corrosion resistant parts that require high strength and good toughness. Among such end products are valve parts, fittings, fasteners, shafts, gears, combustion engine parts, components for chemical processing equipment and paper mill equipment, and components for aircraft and nuclear reactors.

The unique combination of properties provided by the alloy according to the present invention will be appreciated better in the light of the following examples.

EXAMPLES

In order to demonstrate the unique combination of properties provided by the alloy according to the present invention, examples of the alloy were prepared and tested relative to comparative alloys.

Example 1

Four heats, each weighing approximately 400-pounds, were vacuum-induction melted and cast as single 7.5"-square ingots. The chemical analyses of the heats are shown in Table I in weight percent. Heat 1 is an example of the steel according to this invention. Heats A, B, and C are comparative alloys.

TABLE I

| | Element (weight percent) | | | | | | | | | | | | | |
|---|---|---|---|---|---|---|---|---|---|---|---|---|---|---|
| Heat No. | C | Mn | Si | P | S | Cr | Ni | Mo | Cu | Nb | Ta | B | N | Fe |
| 1 | .020 | .30 | .42 | .021 | .009 | 14.87 | 4.72 | .10 | 3.30 | .15 | <.01 | <.0010 | .017 | Bal. |
| A | .020 | .30 | .40 | .021 | <.001 | 14.87 | 4.70 | .10 | 3.30 | .15 | <.01 | <.0010 | .017 | Bal. |
| B | .036 | .31 | .41 | .021 | <.001 | 15.11 | 4.59 | .10 | 3.30 | .26 | <.01 | <.0010 | .017 | Bal. |
| C | .035 | .30 | .41 | .021 | .009 | 15.13 | 4.66 | .10 | 3.31 | .26 | <.01 | <.0010 | .017 | Bal. |

The ingots were press-forged to 4" square billets, cogged to a 2.125" diam. round bars, and then hot rolled to 0.6875" diam. bar. All the bars were solution annealed by heating them to a temperature of 1040 C., soaking for one hour at that temperature, and then water quenching to room temperature. Further processing consisted of straightening the annealed bars, turning to 0.637" diam., restraightening, rough grinding to 0.627" diam., and then grinding the bars to a finish diameter of 0.625".

The microstructure and mechanical properties of the bar products were evaluated and compared relative to the requirements of AMS 5659. Table II shows that little or no ferrite was present in the microstructures of the solution-annealed 0.625" diam. bars.

TABLE II (FERRITE CONTENT IN ANNEALED BARS)

| Heat No. | Ferrite Content (Volume Percent)* |
|---|---|
| 1 | 0.09 |
| A | None Detected |
| B | None Detected |
| C | 0.08 |
| AMS 5659 | 2 Maximum |

*Measured from tint-etched longitudinal metallographic specimens via image analysis of 100 fields at 1050x screen magnification.

A comparison of room-temperature smooth tensile properties and hardness of the four alloys in the annealed condition is given in Table III. The data presented in Table III includes the 0.2% offset yield strength (0.2% Y.S.) and ultimate tensile strength (UTS) in ksi (MPa), the percent elongation in 4 diameters (% Elong.), the reduction in area (% RA), and the Rockwell C hardness (HRC).

TABLE III (LONGITUDINAL SMOOTH TENSILE PROPERTIES AND HARDNESS OF ANNEALED BARS)

| | Smooth Tensile Properties[1] | | | | |
|---|---|---|---|---|---|
| Heat No. | .2% Y. S. | UTS | % Elong. | % RA | HRC[2] |
| 1 | 135.0 | 149.6 | 15.9 | 70.8 | 31 |
| A | 139.1 | 149.5 | 16.3 | 77.5 | 31 |
| B | 143.6 | 155.3 | 15.8 | 73.9 | 32 |
| C | 138.6 | 154.0 | 15.5 | 70.8 | 32.5 |
| AMS 5659 | — | 175 max. | — | — | 39.1 max.[3] |

[1]Average of duplicate specimens.
[2]Average of four measurements taken at midradius location.
[3]Converted from HB scale.

A comparison of room-temperature smooth tensile properties and hardness was also developed for the alloys in the various aged conditions specified in AMS 5659. Results are presented in Table IV including the 0.2% offset yield strength (0.2% Y.S.) and ultimate tensile strength (UTS) in ksi (MPa), the percent elongation in 4 diameters (Elong.), the reduction in area (RA), and the Rockwell C hardness (HRC).

TABLE IV (LONGITUDINAL SMOOTH TENSILE PROPERTIES AND HARDNESS Of AGED-HARDENED BARS)

| | | Smooth Tensile Properties[1] | | | | |
|---|---|---|---|---|---|---|
| Heat No. | Condition[2] | .2% YS | UTS | Elong. | RA | HRC[3] |
| 1 | H900 | 189.8 | 199.0 | 14.1 | 51.4 | 43 |
| A | H900 | 192.8 | 198.6 | 14.5 | 56.6 | 43 |
| B | H900 | 193.6 | 199.7 | 14.8 | 59.6 | 43 |
| C | H900 | 190.6 | 199.3 | 14.4 | 59.7 | 43 |
| AMS 5659 | H900 | 170 min. | 190 min. | 10 min. | 35 min. | 41.8–47.1[4] |
| 1 | H925 | 178.7 | 186.7 | 14.4 | 55.6 | 41 |
| A | H925 | 178.6 | 185.3 | 14.5 | 55.1 | 41 |
| B | H925 | 179.8 | 184.9 | 16.4 | 64.9 | 41 |
| C | H925 | 177.6 | 184.9 | 16.7 | 61.6 | 41 |
| AMS 5659 | H925 | 155 min. | 170 min. | 10 min. | 38 min. | 40.4–45.7[4] |

TABLE IV-continued (LONGITUDINAL SMOOTH TENSILE PROPERTIES AND HARDNESS Of AGED-HARDENED BARS)

| | | Smooth Tensile Properties[1] | | | | |
|---|---|---|---|---|---|---|
| Heat No. | Condition[2] | .2% YS | UTS | Elong. | RA | HRC[3] |
| 1 | H1025 | 159.6 | 163.8 | 15.3 | 62.1 | 36 |
| A | H1025 | 157.8 | 162.5 | 16.1 | 63.6 | 36 |
| B | H1025 | 160.5 | 164.0 | 16.1 | 65.6 | 36 |
| C | H1025 | 159.6 | 163.3 | 16.1 | 65.4 | 36 |
| AMS 5659 | H1025 | 145 min. | 155 min. | 12 min. | 45 min. | 35.5–43.1[4] |
| 1 | H1150 | 115.3 | 139.0 | 21.3 | 68.9 | 30 |
| A | H1150 | 115.8 | 138.6 | 23.3 | 73.2 | 30 |
| B | H1150 | 113.3 | 138.2 | 21.7 | 71.7 | 30 |
| C | H1150 | 109.6 | 138.1 | 21.8 | 70.2 | 30 |
| AMS 5659 | H1150 | 105 min. | 135 min. | 16 min. | 50 min. | 28.8–37.9[4] |

[1]Average of duplicate specimens.
[2]Aging cycles are defined as follows: H900: 900 F/1 hour/air cool H925: 925 F/4 hours/air cool H1025: 1025 F/4 hours/air cool H1150: 1150 F/4 hours/air cool
[3]Average of four measurements.
[4]Converted from HB scale.

The data presented in Tables III and IV show that the hardness and smooth tensile properties of the four alloys are similar and that they all satisfy the requirements of AMS 5659 under the respective heat treating conditions.

The machinabilities of the annealed 0.625" diam. bars of each alloy were tested by employing a Brown and Sharpe Ultramatic (single spindle) Screw Machine. Spindle speed was utilized as the variable test parameter. Three tests were conducted on all four heats at speeds of 95.5 and 104.3 surface feet per minute (SFM). A given trial was terminated for one of two reasons a) part growth exceeding 0.003" as a result of tool wear (Part Growth) or b) at least 400 parts were machined without 0.003" part growth (Discontinued). Catastrophic tool failure, a third reason for test termination, was not experienced in this testing. The screw machine test parameters and results are provided in Table V, including the spindle speed (Spindle Speed) in SFM, the number of parts machined (Total Parts) and the reason for terminating each test (Reason for Test Termination).

TABLE V (SCREW MACHINE TEST RESULTS FOR ANNEALED BARS)

| Heat No. | Spindle Speed | Total Parts | Reason for Test Termination |
|---|---|---|---|
| 1 | 95.5 | 400 | Discontinued |
| 1 | 95.5 | 400 | Discontinued |
| 1 | 95.5 | 370 | Part Growth |
| 1 | 104.3 | 240 | Part Growth |
| 1 | 104.3 | 180 | Part Growth |
| 1 | 104.3 | 230 | Part Growth |
| A | 95.5 | 110 | Part Growth |
| A | 95.5 | 110 | Part Growth |
| A | 95.5 | 160 | Part Growth |
| A | 104.3 | 90 | Part Growth |
| A | 104.3 | 80 | Part Growth |
| A | 104.3 | 80 | Part Growth |
| B | 95.5 | 40 | Part Growth |
| B | 95.5 | 30 | Part Growth |
| B | 95.5 | 30 | Part Growth |
| B | 104.3 | 30 | Part Growth |
| B | 104.3 | 40 | Part Growth |

TABLE V-continued (SCREW MACHINE TEST RESULTS FOR ANNEALED BARS)

| Heat No. | Spindle Speed | Total Parts | Reason for Test Termination |
|---|---|---|---|
| B | 104.3 | 45 | Part Growth |
| C | 95.5 | 90 | Part Growth |
| C | 95.5 | 90 | Part Growth |
| C | 95.5 | 80 | Part Growth |
| C | 104.3 | 50 | Part Growth |
| C | 104.3 | 60 | Part Growth |
| C | 104.3 | 60 | Part Growth |

(1)A rough form tool feed rate of 0.002 ipr (inches per revolution) was utilized for all tests.

Set forth in Table VI is a summary of the data presented in Table V above, including the number of parts machined at each spindle speed (Parts Machined). The mean and standard deviation values for the comparative alloys are also shown.

TABLE VI (SCREW MACHINE TEST RESULT SUMMARY ANNEALED BARS)

| Heat No. | | Mean | Standard Deviation |
|---|---|---|---|
| | Parts Machines at 95.5 SFM | | |
| 1 | >400*, >400*, 370 | — | — |
| A | 110, 110, 160 | 127 | 28.9 |
| B | 40, 30, 30 | 33 | 5.8 |
| C | 90, 90, 80 | 87 | 5.8 |
| | Parts Machines at 104.3 SFM | | |
| 1 | 240, 180, 230 | 217 | 32.1 |
| A | 90, 80, 80 | 83 | 5.8 |
| B | 30, 40, 45 | 38 | 7.6 |
| C | 50, 60, 60 | 57 | 5.8 |

*Test discontinued because of runout.

When viewed together, the data in Tables II to VI show that Heat 1 provides a significantly better combination of properties relative to Heats A, B, and C, because it provides superior machinability while maintaining the mechanical and microstructural property requirements of AMS 5659.

Example 2

Six 400 lb. heats were vacuum induction melted and cast as 7½" ingots. The chemical analyses of the heats are shown in Table VII in weight percent. Heats 2, 3, and 4 are examples of the steel according to this invention and Heats D, E, and F are comparative alloys.

Heat 2 was prepared for comparison with Heat D, Heat 3 was prepared for comparison with Heat E, and Heat 4 was prepared for comparison with Heat F. The ingots were press forged to 4" square bars as described above in Example 1. The 4" square bars of Heats 2 and D were further processed to ⅝" diam. round bars as described above in Example 1.

A comparison of the room-temperature, longitudinal smooth tensile properties and hardness of Heats 2 and D in the annealed and H1150 conditions is given in Tables VIIIA and VIIIB. Prior to testing, the bars of each heat were annealed at 1040 C. for 1 hour and then water quenched. Subsequently, the bars of each heat were age hardened by heating at 1150 F. for 4 hours and then air cooled. The data presented in Tables VIIIA and VIIIB include the 0.2% offset yield strength (0.2% Y.S.) and ultimate tensile strength (UTS) in ksi (MPa), the percent elongation in 4 diameters (% Elong.), the reduction in area (% RA), and the Rockwell C hardness (HRC). Also shown for reference are the tensile and hardness requirements specified in AMS 5659.

TABLE VIIIA (SMOOTH TENSILE PROPERTIES AND HARDNESS OF ANNEALED BARS)

| | Annealed Bar Properties(1) | | | | |
|---|---|---|---|---|---|
| Heat No. | .2% Y. S. | UTS | % Elong. | % RA | HRC(2) |
| 2 | 143.3 | 148.2 | 15.5 | 70.4 | 31 |
| D | 134.1 | 138.5 | 15.7 | 72.8 | 27.5 |
| AMS 5659 | — | 175 max. | — | — | 39.1 max. |

(1)Average of duplicate .250" diam. gage smooth tensile specimens.
(2)Average hardness on cross section of bar at midradius.

TABLE VIIIB (SMOOTH TENSILE PROPERTIES AND HARDNESS OF H1150 BARS)

| | Age-Hardened Bar Properties(1) | | | | |
|---|---|---|---|---|---|
| Heat No. | .2% Y. S. | UTS | % Elong. | % RA | HRC(2) |
| 2 | 111.4 | 138.0 | 22.4 | 69.4 | 29.0 |
| D | 125.2 | 138.2 | 21.1 | 73.1 | 29.0 |
| AMS 5659 | 105 min. | 135 min. | 16 min. | 50 min. | 28.8–37.9 |

(1)Average of duplicate .250" diam. gage smooth tensile specimens.
(2)Average hardness on cross section of bar at midradius.

Set forth in Tables IX and X are the results of machinability testing of the ⅝" bars of Heats 2 and D in the H 1150

TABLE VII

| | Element (weight percent) | | | | | | | | | | | | | |
|---|---|---|---|---|---|---|---|---|---|---|---|---|---|---|
| Heat No. | C | Mn | Si | P | S | Cr | Ni | Mo | Cu | Nb | Ta | B | N | Fe |
| 2 | .022 | .45 | .23 | .026 | .006 | 15.31 | 4.73 | .25 | 3.78 | .21 | <.01 | <.0010 | .017 | Bal. |
| 3 | .026 | .51 | .48 | .023 | .014 | 15.32 | 4.28 | .12 | 3.28 | .20 | <.01 | .0011 | .018 | Bal. |
| 4 | .020 | .51 | .45 | .028 | .011 | 15.28 | 4.80 | .27 | 3.16 | .20 | <.01 | .0020 | .013 | Bal. |
| D | .022 | .44 | .23 | .028 | .003 | 15.29 | 4.73 | .25 | 3.79 | .45 | <.01 | <.0010 | .017 | Bal. |
| E | .034 | .63 | .49 | .025 | .020 | 15.71 | 4.29 | .12 | 3.29 | .26 | <.01 | .0011 | .017 | Bal. |
| F | .020 | .52 | .45 | .026 | .018 | 15.56 | 4.81 | .27 | 3.16 | .22 | <.01 | .0021 | .013 | Bal. |

age-hardened condition. Table IX shows the results for duplicate tests of each heat on the automatic screw machine as described in Example 1 above, including the relative amounts of C, S, and Nb, in weight percent, and the number of parts machined (Total Parts) until test termination. In each case the spindle speed was 104.3 SFM and the tool feed rate was 0.002 inches per revolution (ipr).

TABLE IX (SCREW MACHINE TEST RESULTS FOR H1150 AGE-HARDENED BARS)

| Heat No. | % C | % S | % Nb | Total Parts | Reason for Test Termination |
|---|---|---|---|---|---|
| 2 | .022 | .006 | .21 | 140 | Part Growth |
| | | | | 160 | Part Growth |
| D | .022 | .003 | .45 | 90 | Part Growth |
| | | | | 80 | Part Growth |

Set forth in Table X below are the results of duplicate tool life tests on each heat, including the relative amounts of C, S, and Nb, in weight percent, the tool failure limit (Tool Failure) expressed in inches (cm) to failure and time to failure (sec.), and the volume of material cut from the test bar (Cut Vol.) in $in^3$ ($cm^3$). In this test, lengths of bars of each heat were turned on a single point lathe employing cutting tool having a T15 high speed steel insert. Accelerated feed and machining speed parameters were selected to produce a catastrophic tool failure. All tests were conducted with a spindle speed of 200 SFM and a tool feed rate of .0132 ipr to achieve a material removal rate of 1.78 $in^3$/minute.

TABLE X (TOOL LIFE TEST RESULTS FOR H1150 AGE-HARDENED BARS)

| Heat No. | % C | % S | % Nb | Tool Failure Inches | Tool Failure Sec. | Cut Vol. |
|---|---|---|---|---|---|---|
| 2 | .022 | .006 | .21 | 2.12 | 7.9 | .235 |
| | | | | 2.23 | 8.3 | .246 |
| | | | Avg. | 2.18 | 8.1 | .241 |
| D | .022 | .003 | .45 | 1.99 | 7.4 | .220 |
| | | | | 1.40 | 5.2 | .154 |
| | | | Avg. | 1.70 | 6.3 | .187 |

The data in Tables IX and X show that Heat 2, representing an alloy according to present invention, provides superior machinability relative to Heat D when the alloys are in the age-hardened condition (H1150).

Set forth in Tables XIA and XIB are the results of smooth and notch tensile, impact toughness, hardness, and fracture toughness testing of the 4" bars of Heats 3, 4, E, and F in the H1150 age-hardened condition. Table XIA presents data for longitudinally oriented specimens and Table XIB presents data for transversely oriented specimens. The results shown in Tables XIA and XIB include the 0.2% offset yield strength (0.2% Y.S.) and ultimate tensile strength (UTS ) in ksi (MPa), the percent elongation in 4 diameters (% Elong.), the reduction in area (% RA), the notched tensile strength (NTS) in ksi (MPa), the NTS/UTS ratio (NTS/UTS), the Charpy V-notch impact strength (CVN) in ft-lbs (J), the Rockwell C hardness (HRC), and the fracture toughness ($K_Q$) in ksi$\sqrt{in}$ (MPa$\sqrt{m}$).

TABLE XIA (LONGITUDINAL MECHANICAL PROPERTIES OF H1150 AGE-HARDENED BARS)

| Heat No. | Smooth Tensile Properties(1) *2% Y.S. | UTS | % Elong. | % RA | NTS(2) | NTS/UTS(3) | CVN(4) | HRC(5) | $K_Q$(6) |
|---|---|---|---|---|---|---|---|---|---|
| 3 | 126.0 | 141.7 | 20.8 | 68.6 | 219.5 | | 106,104,103 | | 147.2 |
| | 127.4 | 142.2 | 21.1 | 68.7 | 222.2 | 1.56 | Avg. 104 | 31 | 145.8 |
| E | 117.8 | 140.9 | 21.0 | 66.6 | 218.7 | | 96,94,87 | | 123.4 |
| | 117.1 | 140.6 | 20.9 | 66.5 | 217.1 | 1.55 | Avg. 92 | 31 | 119.9 |
| 4 | 109.4 | 136.5 | 23.4 | 69.7 | 212.2 | | 140,132,130 | | 98.2 |
| | 110.5 | 137.0 | 23.4 | 71.5 | 212.3 | 1.55 | Avg. 134 | 29 | 99.1 |
| F | 110.0 | 138.4 | 22.9 | 71.5 | 219.0 | | 119,117,117 | | 92.3 |
| | 111.7 | 138.5 | 22.4 | 71.2 | 216.6 | 1.57 | Avg. 118 | 29 | 90.3 |
| AMS 5659 | 105 min. | 135 min. | 16 min. | 50 min. | | | | 28.8–37.9 | |

(1).250" diam. gage smooth tensile specimens.

(2)$K_t$ = 10 (d = .252", D = .357" with root radius of .0010").

(3)Average NTS/ Average UTS.

(4)Std CVN impact specimens having L-T notch orientation.

(5)Average hardness measured on section of fractured CVN impact specimens.

(6)Std 1-1/2" thick compact tension specimens having an L-T slot orientation.

TABLE XIB (TRANSVERSE MECHANICAL PROPERTIES OF H1150 AGE-HARDENED BARS)

| | Smooth Tensile Properties[1] | | | | | | | | |
|---|---|---|---|---|---|---|---|---|---|
| Heat No. | *2% Y.S. | UTS | % Elong. | % RA | NTS[2] | NTS/UTS[3] | CVN[4] | HRC[5] | $K_Q$[6] |
| 3 | 125.1 | 141.1 | 17.5 | 53.7 | 218.3 | | 51, 46, 45 | | 109.0 |
| | 123.3 | 140.5 | 18.7 | 59.4 | 220.7 | 1.56 | Avg. 47 | 30 | 108.0 |
| E | 120.0 | 141.1 | 16.1 | 42.5 | 212.6 | | 39, 39, 27 | | 106.3 |
| | 111.9 | 139.2 | 19.0 | 56.7 | 212.0 | 1.51 | Avg. 35 | 30 | 89.0 |
| D | 108.6 | 136.8 | 21.1 | 65.0 | 210.0 | | 85, 72, 69 | | 96.7 |
| | 108.4 | 136.0 | 21.0 | 66.0 | 206.9 | 1.53 | Avg. 75 | 29 | 97.8 |
| F | 110.3 | 138.6 | 19.8 | 58.9 | 208.0 | | 55, 55, 50 | | 94.0 |
| | 108.7 | 138.1 | 19.8 | 58.2 | 206.8 | 1.50 | Avg. 53 | 29.5 | 85.3 |
| AMS 5659 | 105 min. | 135 min. | 11 min. | 35 min. | | | | 28.8–37.9 | |

(1).250" diam. gage smooth tensile specimens.
(2)$K_t$ = 10 (d = .252", D = .357" with root radius of .0010").
(3)Average NTS/ Average UTS.
(4)Std CVN impact specimens having T-L notch orientation.
(5)Average hardness measured on section of fractured CVN impact specimens.
(6)Std 1-1/2" thick compact tension specimens having an T-L slot orientation.

The data in Table XIA show that Heats 4 and 5, which are alloys according to the present invention, although providing similar smooth and notch tensile properties and hardness relative to Heats E and F, respectively, provide superior impact toughness and fracture toughness characteristics relative to those alloys. Similar results are demonstrated in Table XIB for the transversely oriented specimens, although at somewhat lower levels than the corresponding longitudinal properties. Good impact toughness and fracture toughness are especially important for materials used in critical structural components.

Considering the data presented in Tables VIIIA, VIIIB, IX, X, XIA, and XIB together, they clearly show the superior combination of strength, toughness, ductility, and machinability provided by the alloy according to the present invention.

The terms and expressions which have been employed herein are used as terms of description, not of limitation. There is no intention in the use of such terms and expressions of excluding any equivalents of the elements or features shown and described or portions thereof. However, it is recognized that various modifications are possible within the scope of the invention claimed.

What is claimed is:

1. A precipitation-hardenable, martensitic stainless steel alloy, consisting essentially of, in weight percent, about

| | |
|---|---|
| C | 0.030 max. |
| Mn | 0.50 max. |
| Si | 1.00 max. |
| P | 0.025 max. |
| S | 0.007–0.015 |
| Cr | 14.00–15.50 |
| Ni | 3.50–5.50 |
| Mo | 1.00 max. |
| Cu | 2.50–4.50 |
| Nb + Ta | (5 × C)–0.25 |
| Al | 0.05 max. |
| B | 0.010 max. |
| N | 0.030 max. |

and the balance is essentially iron and the usual impurities.

2. A precipitation-hardenable, martensitic stainless steel alloy as set forth in claim 1 containing at least about 0.010% carbon.

3. A precipitation-hardenable, martensitic stainless steel alloy as set forth in claim 1 containing not more than about 0.013% sulfur.

4. A precipitation-hardenable, martensitic stainless steel alloy as set forth in claim 1 containing at least about 4.00% nickel.

5. A precipitation-hardenable, martensitic stainless steel alloy as set forth in claim 1 containing not more than about 0.50% molybdenum.

6. A precipitation-hardenable, martensitic stainless steel alloy as set forth in claim 1 containing not more than about 0.025 nitrogen.

7. A precipitation-hardenable, martensitic stainless steel alloy as set forth in claim 1 containing not more than about 4.00% copper.

8. A precipitation-hardenable, martensitic stainless steel alloy, consisting essentially of, in weight percent, about

| | |
|---|---|
| C | 0.025 max. |
| Mn | 0.50 max. |
| Si | 0.50 max. |
| P | 0.030 max. |
| S | 0.007–0.015 |
| Cr | 14.00–15.50 |
| Ni | 3.50–5.50 |
| Mo | 0.50 max. |
| Cu | 2.50–4.50 |
| Nb + Ta | (5 × C) – 0.25 |
| Al | 0.025 max. |
| B | 0.005 max. |
| N | 0.025 max. |

and the balance is essentially iron and the usual impurities.

9. A precipitation-hardenable, martensitic stainless steel alloy as set forth in claim 8 containing at least about 0.010% carbon.

10. A precipitation-hardenable, martensitic stainless steel alloy as set forth in claim 8 containing not more than about 0.013% sulfur.

11. A precipitation-hardenable, martensitic stainless steel alloy as set forth in claim 8 containing not more than about 15.25% chromium.

12. A precipitation-hardenable, martensitic stainless steel alloy as set forth in claim 8 containing at least about 4.00% nickel.

13. A precipitation-hardenable, martensitic stainless steel alloy as set forth in claim 8 containing not more than about 0.20% niobium-plus-tantalum.

14. A precipitation-hardenable, martensitic stainless steel alloy as set forth in claim 8 containing at least about 0.010% nitrogen.

15. A precipitation-hardenable, martensitic stainless steel alloy as set forth in claim 8 containing not more than about 4.00% copper.

16. A precipitation-hardenable, martensitic stainless steel alloy, consisting essentially of, in weight percent, about

| | |
|---|---|
| C | 0.010–0.025 |
| Mn | 0.50 max. |
| Si | 0.50 max. |
| P | 0.025 max. |
| S | 0.007–0.013 |
| Cr | 14.25–15.25 |
| Ni | 4.00–5.50 |
| Mo | 0.50 max. |
| Cu | 3.00–4.00 |
| Nb + Ta | (5 × C) − 0.20 |
| Al | 0.025 max. |
| B | 0.005 max. |
| N | 0.010–0.025 |

and the balance is essentially iron and the usual impurities.

17. A steel article that provides a unique combination of machinability, hardness, strength, ductility, and toughness, in the age-hardened condition, said article being formed of a precipitation-hardenable, martensitic stainless steel alloy consisting essentially of, in weight percent, about:

| | |
|---|---|
| C | 0.030 max. |
| Mn | 0.50 max. |
| Si | 1.00 max. |
| P | 0.030 max. |
| S | 0.007–0.015 |
| Cr | 14.00–15.50 |
| Ni | 3.50–5.50 |
| Mo | 1.00 max. |
| Cu | 2.50–4.50 |
| Nb + Ta | (5 × C)–0.25 |
| Al | 0.05 max. |
| B | 0.010 max. |
| N | 0.030 max. |

and the balance is essentially iron and the usual impurities.

18. A steel article as set forth in claim 17 wherein the alloy contains not more than about 0.020% carbon.

19. A steel article as set forth in claim 18 wherein the alloy contains not more than about 0.20% niobium+tantalum.

* * * * *